US008339225B2

(12) United States Patent
Nendel

(10) Patent No.: US 8,339,225 B2
(45) Date of Patent: Dec. 25, 2012

(54) ELECTROMAGNETIC ACTUATING DEVICE

(75) Inventor: Andreas Nendel, Hessdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 13 days.

(21) Appl. No.: 13/133,802

(22) PCT Filed: Feb. 11, 2010

(86) PCT No.: PCT/EP2010/051715

§ 371 (c)(1),
(2), (4) Date: Jun. 9, 2011

(87) PCT Pub. No.: WO2010/097298

PCT Pub. Date: Sep. 2, 2010

(65) Prior Publication Data

US 2011/0240892 A1 Oct. 6, 2011

(30) Foreign Application Priority Data

Feb. 27, 2009 (DE) ..... 10 2009 010 949

(51) Int. Cl.

| | |
|---|---|
| ***H01F 7/00*** | (2006.01) |
| ***H01F 7/08*** | (2006.01) |
| ***F01L 9/04*** | (2006.01) |
| ***F16K 31/02*** | (2006.01) |

(52) U.S. Cl. ..... 335/229; 335/230; 335/232; 335/233; 335/234; 335/177; 335/179; 251/129.01; 123/90.11

(58) Field of Classification Search ..... 335/229–230, 335/232–234, 177, 179; 251/129.01; 123/90.11
See application file for complete search history.

(56) References Cited

U.S. PATENT DOCUMENTS

| | | | | |
|---|---|---|---|---|
| 4,236,132 | A * | 11/1980 | Zissimopoulos | 335/271 |
| 4,779,582 | A * | 10/1988 | Lequesne | 123/90.11 |
| 5,543,766 | A * | 8/1996 | Bagalini | 335/177 |
| 7,965,161 | B2 * | 6/2011 | Roche | 335/229 |
| 8,235,011 | B2 * | 8/2012 | Lengfeld et al. | 123/90.11 |
| 2008/0164964 | A1 * | 7/2008 | Nelson | 335/229 |
| 2010/0180850 | A1 * | 7/2010 | Lengfeld et al. | 123/188.1 |

FOREIGN PATENT DOCUMENTS

| | | |
|---|---|---|
| DE | 19611641 | 6/1997 |
| DE | 102004021376 | 12/2005 |

(Continued)

*Primary Examiner* — Mohamad Musleh
(74) *Attorney, Agent, or Firm* — Volpe and Koenig, P.C.

(57) ABSTRACT

An electromagnetic actuating device (1) having a housing (2) and two actuator pins (3, 4) that are supported in the housing so as to be movable independently of each other between a retracted rest position and an extended working position, and locking pins (7, 8) that hold the actuator pins in the rest position via locking mechanisms and that can be moved relative to the actuator pins in the movement direction of the actuator pins. A force is applied to the locking pins in the extension direction by further spring elements (15), and the locking pins are moved in the retraction direction by electromagnetic force application in order to unlock the locking mechanisms. The actuating device is an electromagnet (22) associated with the locking pins in common and having a reversible direction of the magnetic field, and the end sections (19) of the locking pins facing away from the actuator pins are provided with bipolar permanent magnets (20, 21) that are oriented with opposite polarities in the movement direction.

9 Claims, 1 Drawing Sheet

FOREIGN PATENT DOCUMENTS

| | | |
|---|---|---|
| DE | 102006051809 | 5/2008 |
| DE | 102007010156 | 9/2008 |
| DE | 102007024598 | 11/2008 |
| DE | 102007024600 | 11/2008 |
| DE | 202008008142 | 12/2008 |
| WO | 03021612 | 3/2003 |

* cited by examiner

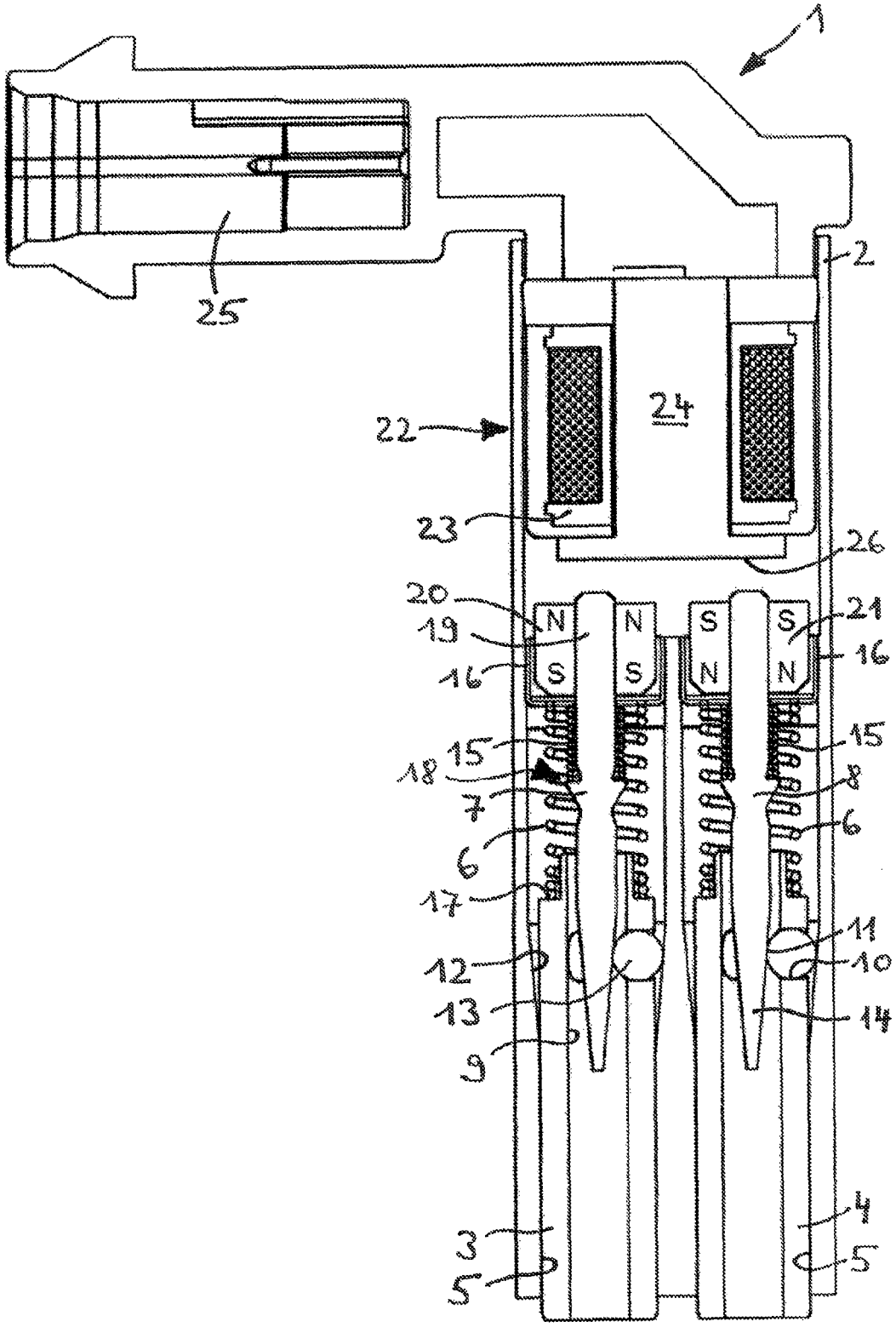
1
2
25
24
22
23
26
20
19
16
18
15
7
6
17
12
13
9
3
5
N
S
N
S
S
N
S
N
21
16
15
8
6
11
10
14
4
5

ELECTROMAGNETIC ACTUATING DEVICE

FIELD OF THE INVENTION

The invention relates to an electromagnetic actuating device with a housing and two actuator pins that are supported in the housing displaceable independently from each other between a rest position retracted into the housing and a working position extended out from the housing and are loaded by application of force by spring elements in the extension direction, as well as locking pins that hold the actuator pins in the rest position by catches and are displaceable relative to these actuator pins in the movement direction of the actuator pins. Here, the locking pins are loaded by application of force by additional spring elements in the extension direction and are displaced in the retraction direction by application of electromagnetic force for releasing the catches.

BACKGROUND

Such an actuating device is suitable, to a special degree, for the adjustment of lift-variable valve drives of internal combustion engines and its principle function emerges, for example, from DE 10 2004 021 376 A1. The lift variability of this valve drive is based on a cam part with two cams that are arranged directly adjacent to each other on this cam part and the different opening profiles of these cams are transferred selectively to a gas-exchange valve by a cam follower with a conventionally rigid construction. For the operating point-dependent setting of these opening profiles, the cam part is arranged locked in rotation, but longitudinally displaceable on a carrier shaft and has two spiral-shaped displacement grooves running in opposite directions and in which the end sections of the actuator pins of two actuating devices are selectively coupled (with only one actuator pin). While the axial profile guides the displacement groove engaged with the associated actuator pin such that the cam part shifts in a self-controlling and camshaft angle-true manner from one cam position into the other, the radial profile of each displacement groove is shaped so that this becomes increasingly flatter at the end of the displacement process and displaces the currently engaged actuator pin from its working position back into the rest position.

In the case of the valve drive proposed in DE 196 11 641 C1 with three adjacent cams and two actuator pins arranged at a slight distance, it appears preferable to integrate the actuator pins in a common housing.

An actuating device with a group of actuator pins that are displaceable independently from each other and are supported in a common housing and interact with locking pins loaded by the application of electromagnetic force in the way mentioned above follows from DE 10 2006 051 809 A1, which is considered to be class-forming. The application of electromagnetic force by the locking pins takes place through the use of magnetic armatures that are mounted on these pins and each of which forms an electric lifting magnet. Thus, in the case of two actuator pins, two such electric lifting magnets are required with corresponding high effort for production and assembly of the actuating device.

This consideration relates in the same way for an actuating device according to DE 10 2007 024 598 A1 if a group of actuator pins should be combined in a common housing.

In WO 03/021612 A1, an actuating device is proposed whose actuation is based on the interaction of an electromagnet with a permanent magnet mounted on the actuator pin. Due to its force of magnetic attraction, the actuator pin loaded by the application of spring force in the extension direction attaches to the non-energized electromagnet. For detaching the actuator pin from this rest position, only one application of a pulse-shaped current of the electromagnet is required for overcoming the force of magnetic attraction of the permanent magnet, wherein the actuator pin is accelerated in the direction of the working position not only by the force of the spring means, but also by the force of a magnetic repulsion effect between the permanent magnet and the energized electromagnet.

A structural refinement of this functional principle is disclosed in DE 20 2008 008 142 U1. The actuator pin is held there on a permanent magnet merely by the force of magnetic attraction, so that through mutual eccentric arrangement of actuator pins and permanent magnet/electromagnet, a compact construction of the actuating device is made possible with two or three actuator pins in a common housing.

Apart from the common housing, all of the mentioned actuating devices with multiple actuator pins require a considerable effort of fabrication and assembly, because cost-related synergy effects are produced mainly only by the common housing.

SUMMARY

The present invention is therefore based on the objective of refining an actuating device of the type noted above so that the actuating device not only requires the smallest possible structural space and has a small spacing of the actuator pins, but also can be fabricated and assembled with as little effort as possible.

The solution of this objective is given by the invention, while advantageous refinements and constructions can be taken from the description and claims. Accordingly, the objective is met in that the actuating device has an electromagnet allocated jointly to the locking pins with reversible direction of the magnetic field and end sections of the locking pins facing away from the actuator pins are provided with two-pole, magnetized permanent magnets that are oriented relative to each other oppositely poled in the movement direction.

Consequently, only one electromagnet energized with reversible poles is required for two actuator pins that are displaceable independently from each other.

The opposite orientation of the permanent magnet poles leads to the result that, for the energizing of the electromagnet, the same magnetic field attracts the first permanent magnet and repels the second permanent magnet. Here, the locking pin connected to the first permanent magnet is displaced against the force of the additional spring element in the direction of the electromagnet, i.e., in the retraction direction of the associated first actuator pin that is displaced into its working position for a now released catch. Accordingly, the locking pin connected to the second permanent magnet and the associated second actuator pin remain at rest.

For oppositely poled energizing of the electromagnet, the effect of the magnetic field reverses itself, so that now the second permanent magnet is attracted, while the first permanent magnet is repelled. The starting point here is again the state that both actuator pins are held in their rest positions by the catches. Analogously, the second actuator pin is now displaced into its working position, while the first actuator pin stays in its rest position.

In one refinement of the invention, the permanent magnets should run spaced apart relative to the core region when the end sections of the locking pins facing away from the actuator pins contact a stationary core region of the electromagnet. Through this measure, the exponentially increasing effect of the force of the permanent magnets in the near field relative to the electromagnet can be limited to such a degree that, for a non-energized electromagnet, a sufficient effect of the additional spring elements retracting the locking pins remains.

In a structurally preferable way, the core region forms a flat contact face for the locking pins, wherein the end sections of the locking pins facing away from the actuator pins have a raised profile relative to the permanent magnet.

In a preferred construction, the catches should each be formed by the following features:

a longitudinal drilled hole running in the actuator pin for holding the locking pin and one or more transverse drilled holes intersecting the longitudinal drilled hole, a first support surface constructed on the locking pin and a second support surface constructed in the housing, wherein at least one of the support surfaces has an inclined profile relative to the movement direction, and catch bodies that are arranged moveable in the transverse drilled holes and are clamped in the rest position between the support surfaces.

For such a catch based on a positive fit or friction fit, only small active surfaces are required, in order to hold the associated actuator pin reliably in its rest position against the force of the spring elements. In contrast to the retaining forces that can be generated in this way, the required forces for releasing the catch are smaller by a multiple, because in addition to the force of the additional spring elements loading the locking pin, only the friction forces acting between the catch bodies and the support surfaces are to be overcome.

The catch body or bodies are preferably constructed as balls, as can be inferred as an extremely economical mass-produced product of a roller body production. Here, three balls and three transverse drilled holes distributed uniformly across the periphery of the actuator pin could be provided. This arrangement is advantageous relative to only one catch body in so far as either for identical dimensioning of the catch bodies, greater retaining forces can be generated or for smaller dimensioning of the catch bodies—corresponding to further reduced structural space requirements of the catch—the optionally already sufficient retaining force of only one catch body can be generated. On the other hand, the arrangement of balls distributed around the periphery by 120° leads to a mechanically most favorable, centered support of the locking pin in the elongated drilled hole of the actuator pin. Nevertheless, arrangements with only one, two, four, or more balls are also obviously possible.

In addition, the balls could be clamped in a self-locking manner between the support surfaces, wherein the support surfaces have, relative to each other, a constant distance or a distance that decreases in the retraction direction. For example, the second support surface could run parallel to the movement direction of the actuator pin and could be part of a production-favorable, continuous, cylindrical longitudinal guidance for the actuator pin. In the structural design of the support surfaces, obviously both the forces of the spring elements and also the friction relationships on the ball-support surface contacts are to be taken into consideration, so that they do not leave the region of self-locking on these contacts required for a trouble-free functioning of the catch.

Here it is preferred that the first support surface on the locking pin tapers in the radial, extension direction and that the support surfaces run parallel to each other. In the case of rotationally symmetric support surfaces, the support surfaces then have a circular truncated cone-shaped construction. This construction allows an especially low-wear sliding or rolling contact between the balls and the support surfaces when the actuator pin leaves the rest position and reaches it again.

BRIEF DESCRIPTION OF THE DRAWINGS

Additional features of the invention are given from the following description and from the single FIGURE in which an embodiment of an electromagnetic actuating device according to the invention is shown in a longitudinal section.

DETAILED DESCRIPTION OF THE PREFERRED EMBODIMENTS

The FIGURE illustrates an actuating device 1 that is used for controlling a lift-variable valve drive explained above with displaceable cam parts (see DE 196 11 641 C1). The actuating device 1 involves a component that can be mounted in the cylinder head of the internal combustion engine with a housing 2 and two actuator pins 3 and 4 that are arranged in this housing and have a hollow cylindrical construction. The actuator pins 3, 4 constructed as identical parts are supported in longitudinal guides 5 of the housing 2 and can be displaced back and forth independently from each other between a rest position (as shown) retracted into the housing 2 and a working position extended out from the housing 2. As explained above, the actuator pins 3, 4 are engaged, in the (not shown) working position, with an associated displacement groove, in order to displace the cam part.

The actuator pins 3, 4 loaded by application of force by spring elements—here coil compression springs 6—are held by catches in the rest position. A release of the catches is carried out by controllable locking pins 7 and 8 that are likewise constructed as identical parts and can be displaced relative to the actuator pins 3, 4 in their displacement direction.

The catches that are identical with each other are each formed by a longitudinal drilled hole 9 running in the actuator pin 3, 4 and transverse drilled hole 10 intersecting this longitudinal drilled hole, a first support surface 11 constructed on the locking pin 7, 8, and a second support surface 12 constructed in the housing 2, as well as three catch bodies in the form of balls 13. The balls 13 are arranged moveable in the transverse drilled holes 10, which are distributed uniformly on the periphery of the actuator pin 3, 4, and are clamped in the rest position of the actuator pin 3, 4 between the support surfaces 11 and 12. For this purpose, the end section 14 of the locking pin 7, 8 running in the longitudinal drilled hole 9 tapers conically in the extension direction of the actuator pin 3, 4, so that the first support surface 11 forms the outer casing surface of a circular truncated cone. The second support surface 12 in the housing 2 runs at a constant distance to the housing and consequently forms the inner casing surface of a circular truncated cone.

The locking pins 7, 8 are each loaded by application of force by an additional spring element—here a coil compression spring 15—likewise in the extension direction. The angle of inclination of the support surfaces 11, 12 relative to the displacement direction of the actuator pin 3, 4 is selected under consideration of the spring forces acting on the locking pin 7, 8 and the actuator pin 3, 4, as well as the friction relationships on the ball-support surface contacts, so that the balls 13 are clamped in a self-locking manner between the support surfaces 11, 12 and thus reliably fix the actuator pin 3, 4 in the rest position. In the present case, the angle of inclination equals approximately 5°.

The concentric coil compression springs 6, 15 are supported on one side on sockets 16 pressed in the housing 2 and on the other side on circular ring-shaped end faces 17 and 18 of the actuator pins 3, 4 or the locking pins 7, 8. The locking pins 7, 8 are displaced in the retraction direction of the actuator pins 3, 4 loaded by application of electromagnetic force for releasing the catches and are provided, for this purpose, on their end sections 19 facing away from the actuator pins 3, 4, with permanent magnets 20 and 21, respectively, mounted on these end sections. According to the invention, these are magnetized in two poles in the axial direction, oriented opposite each other in the displacement direction of the actuator pins 3, 4 with respect to their north and south poles designated with N and S and exposed to the magnetic field of a single electromagnet 22.

As essential components, the electromagnet 22 comprises a magnetic coil 23, a stationary core region 24, and a 2-pole plug connector 25 as a direct-current connection for the magnetic coil 23. The core region 24 running coaxial in the magnetic coil 23 has, on the side of the permanent magnets 20, 21, a shoulder that forms a flat contact face 26 for the locking pins 7, 8. A strongly binding contact of the permanent magnets 20, 21 on the contact face 26 is therefore avoided, because the end sections 19 of the locking pins 7, 8 have a raised profile relative to the permanent magnets 20, 21 and these always have a corresponding minimum distance to the contact face 26.

The functioning of the actuating device 1 is as follows: if a current voltage with a first pole arrangement (+/−) is applied to the electromagnet 22, then the resulting magnetic field attracts a permanent magnet 20 or 21 and repels the other permanent magnet 21 or 20 due to its reversed pole arrangement. While the repelled permanent magnet 21 or 20, the associated locking pin 8 or 7, and consequently also the associated actuator pin 4 or 3 remain at rest due to the associated, not released catch, the locking pin 7 or 8 attracted to the permanent magnet 20 or 21 is displaced up to the contact face 26 in the retraction direction. Here, the associated catch releases in that the clamping effect of the balls 13 relative to the support surfaces 11, 12 is canceled out. While the balls 13 follow the inclination of the second support surface 12 in the housing 2 and are displaced inward in the transverse drilled holes 10 in the radial direction, the actuator pin 3 or 4 is driven into its working position by the force of the coil compression spring 6. The electromagnet 22 is then switched to a non-energized state, so that the attracted locking pin 7 or 8 returns into its starting position through the force of the coil compression spring 15.

As already mentioned, the engaged actuator pin 3 or 4 is pushed back into its rest position through the outlet region of the displacement groove rising in the radial direction and locked there again. This takes place in that the balls 13 follow the inclined profile of the first support surface 11 on the locking pin 7 or 8, are displaced outward in the transverse drilled holes 10 in the radial direction, and are clamped in a self-locking way between the support surfaces 11, 12.

While the actuator pin 3 or 4 consequently remains in its locked rest position, the actuation of the other actuator pin 4 or 3 is initiated such that current voltage with second pole arrangement (−/+) reversed relative to the first pole arrangement (+/−) is now applied to the electromagnet 22. The reversed effective direction of the magnetic field generated now repels the one permanent magnet 20 or 21 and attracts the other permanent magnet 21 or 20. The additional actuating profile of the actuator pin 4 or 3 takes place in an identical way as explained above.

List Of Reference Symbols

1 Actuating device
2 Housing
3 Actuator pin
4 Actuator pin
5 Longitudinal guide
6 Coil compression spring
7 Locking pin
8 Locking pin
9 Longitudinal drilled hole
10 Transverse drilled hole
11 First support surface
12 Second support surface
13 Ball
14 End section of the locking pin
15 Coil compression spring
16 Socket
17 End surface on the actuator pin
18 End surface on the locking pin
19 End section of the locking pin
20 Permanent magnet
21 Permanent magnet
22 Electromagnet
23 Magnetic coil
24 Stationary core region
25 Plug connector
26 Contact face on the core region

The invention claimed is:

1. Electromagnetic actuating device comprising a housing and two actuator pins that are supported in the housing displaceable independently from each other between a rest position retracted into the housing and a working position extended out from the housing, the actuator pins are loaded by application of force by spring elements in an extension direction, locking pins located in the housing to keep the actuator pins in the rest position by catches and are displaceable relative to the actuator pins in a movement direction of the actuator pins the locking pins are loaded by application of force by additional spring elements in the extension direction and are displaced in a retraction direction by application of electromagnetic force for releasing the catches, the actuating device has an electromagnet allocated jointly to the locking pins with a reversible direction of the magnetic field, and end sections of the locking pins facing away from the actuator pins are provided with two-pole, magnetized permanent magnets that are oriented relative to each other with opposite polarities in the movement direction.

2. Actuating device according to claim 1, wherein the permanent magnets are spaced apart from a stationary core region of the electromagnetic when the end sections of the locking pins facing away from the actuator pins contact the stationary core region of the electromagnet.

3. Actuating device according to claim 2, wherein the core region forms a flat contact face for the locking pins, and the end sections of the locking pins facing away from the actuator pins have a raised profile relative to the permanent magnets.

4. Actuating device according to claim 1, wherein the catches are each formed by:

a longitudinal drilled hole in the actuator pin for holding the locking pin and one or more transverse holes in the actuator pin intersecting the longitudinal hole, a first support surface constructed on the locking pin and a second support surface constructed in the housing, wherein at least one of the support surfaces has an inclined profile relative to the movement direction, and catch bodies that are arranged moveable in the transverse holes and are clamped in the rest position between the support surfaces.

5. Actuating device according to claim 4, wherein the catch bodies comprise balls.

6. Actuating device according to claim 5, wherein three of the balls and three of the transverse drilled holes are distributed uniformly across a periphery of the actuator pin.

7. Actuating device according to claim 5, wherein the balls are clamped in a self-locking manner between the support surfaces, and the support surfaces have, relative to each other, a constant distance or a distance decreasing in the retraction direction.

8. Actuating device according to claim 7, wherein the first support surface tapers in a radial, extension direction and the support surfaces extend parallel to each other.

9. Actuating device according to claim 8, wherein the support surfaces have a circular truncated-cone-shaped construction.

* * * * *